US006520431B2

(12) United States Patent
Donovan

(10) Patent No.: US 6,520,431 B2
(45) Date of Patent: Feb. 18, 2003

(54) EMERGENCY EYEWASH APPARATUS

(75) Inventor: Clarence P. Donovan, Newark, DE (US)

(73) Assignee: Speakman Company, Wilmington, DE (US)

( * ) Notice: Subject to any disclaimer, the term of this patent is extended or adjusted under 35 U.S.C. 154(b) by 0 days.

(21) Appl. No.: 09/865,931

(22) Filed: May 25, 2001

(65) Prior Publication Data

US 2002/0175226 A1 Nov. 28, 2002

(51) Int. Cl.[7] ..... B05B 1/30
(52) U.S. Cl. ..... 239/579; 239/581.1
(58) Field of Search ..... 239/579, 569, 239/436, 16, 274, 581.1, 443; 4/900, 626, 625, 624, 620

(56) References Cited

U.S. PATENT DOCUMENTS

| | | | | |
|---|---|---|---|---|
| 2,999,249 A | | 9/1961 | Logan et al. | |
| 3,106,722 A | | 10/1963 | Logan et al. | |
| 3,925,829 A | * | 12/1975 | Bost | 239/25 |
| 4,585,175 A | | 4/1986 | Formentos | |
| 4,651,770 A | | 3/1987 | Denham et al. | |
| 4,675,924 A | | 6/1987 | Allison et al. | |
| 5,008,963 A | | 4/1991 | Stein | |
| 5,530,972 A | | 7/1996 | Tanner | |
| 5,566,406 A | | 10/1996 | Demeny et al. | |
| 5,647,531 A | | 7/1997 | Kline et al. | |
| 5,695,124 A | | 12/1997 | Demeny et al. | |
| 5,740,569 A | | 4/1998 | Gurries, II et al. | |

FOREIGN PATENT DOCUMENTS

WO WO 97/49021 12/1997

OTHER PUBLICATIONS

Excerpts from www.ces.clemson.edu/chemeng/uolab/valve3.html web page, "Valves" (Feb. 9, 2001).

* cited by examiner

*Primary Examiner*—Lesley D. Morris
(74) *Attorney, Agent, or Firm*—Connolly Bove Lodge & Hutz LLP

(57) ABSTRACT

An eyewash apparatus is disclosed that can be utilized on either side of an associated bowl or sink. Piping extending from spray heads to a housing overlaying a valve can be rotated into position over the sink or bowl. Rotation of the piping initiates or shuts off water flow to eyewash outlets at one end of the piping. The amount of rotation is limited by interaction of a pin traveling in an arcuate slot formed in that part of the apparatus secured to a surface adjacent the sink or bowl. The apparatus can be used on opposite sides of the sink or bowl without a structural change to any components of the apparatus.

5 Claims, 4 Drawing Sheets

EMERGENCY EYEWASH APPARATUS

BACKGROUND OF THE INVENTION

A. Field of the Invention

This invention relates generally to an emergency eyewash apparatus designed to flush harmful contaminants from the eyes and/or face. More specifically, this invention relates to an emergency eyewash apparatus which is more readily operable by a person whose cognitive faculties (sight, smell orientation) are adversely affected by contaminants or caustics. The claimed apparatus is adapted to be installed on a top of a surface next to a sink either in a left or right hand position and activated by simply pulling rotatable swing piping equipped with spray heads.

B. Description of the Related Art

Emergency eyewash devices are generally known in the art for emergency flushing of hazardous substances out of human eyes and face. Usually, such a device includes one or more spray nozzles or spray heads installed on water piping associated with water supply lines. Typically, water flow is initiated by pushing an enlarged push plate that opens a valve in the water supply line, such as described in Wright U.S. Pat. No. 3,809,315.

Other approaches to initiating flow to an eyewash are described in U.S. Pat. Nos. 2,999,249, 5,530,972 and 5,740,569. In each of these patents, the eyewash apparatus is arranged adjacent a sink and flow to, and through, the eyewash is initiated by rotating the piping associated with the eyewash from a stored position outside the perimeter of the sink to a position over the sink. In these prior art devices, piping leading from the water source to the eye wash outlets is arranged to be pivoted in such a way that a slight pull by the user causes rotation of the piping to a position over the sink, which automatically initiates water flow through the eye wash nozzles. The pivotal piping is normally rotated through about ninety degrees between its non-use storage position to its active position over the sink. This rotation can be from the left or right side of sink depending on preselected installation. Stopping means are used to limit the pivotal movement of the piping and adjustment means are disclosed in these patents for accommodating installation at either the left or right side of the sink.

Various approaches to accommodate left side, right side or pull down mounting of the eyewash on a sink are illustrated in U.S. Pat. Nos. 5,530,972 issued to Tanner. This patent also addresses the need for stops to limit the amount of rotation (usually 90°) when the piping bearing the eye wash is rotated from a storage position into an operating position over the sink (See FIGS. 4–5 and column 4 of Tanner patent). This patent also discloses pivotably mounted protective covers for the eyewash nozzles to limit collection of dust, dirt or contaminants in the eyewash nozzles between use.

U.S. Pat. No. 5,740,569 granted in the name of Albert Gurries et al. on Apr. 21, 1998 describes an arrangement for left side or right side mounting of an emergency eyewash adjacent to a sink and pivotal movement thereof over the sink. As in the Tanner patent, complex means are provided to limit rotation of the piping carrying the eye wash nozzles to 90°.

SUMMARY OF THE INVENTION

An object of the present invention is, therefore, to provide an emergency eyewash apparatus with increased reliability in use and improved safety in functioning.

Another object of the invention is to provide easy and simple mounting when reversible installation is desired.

A further object of the invention is to provide such an apparatus which is simple in maintenance owing to simplified assembly.

In accordance with the invention, the eyewash apparatus comprises tubular piping with spray heads attached thereto, a rotatable housing carrying said piping overlying a shank affixed to a surface adjacent the sink, a vertical valve rotatably connected to the housing carrying the piping and a water supply pipe.

The piping with spray heads is capable of being rotated with the valve about a vertical axis. Typical rotation of the piping and associated valving is about 90°, and is controlled by an arcuate slot in a housing overlying the valve. An adjustably mounted pin in the housing extends through the slot to limit movement of the housing carrying the piping. The arcuate slot and associated pin are designed to permit left or right hand installation of the eyewash, in relation to the sink bowl.

Concentrically aligned within the housing carrying the eye wash piping is a valve, preferably a ceramic valve of the type disclosed in Denham et al. U.S. Pat. No. 4,651,770 assigned to Speakman Company of Wilmington, Del. This valve operates between full-open and full-close with a simple 90° rotation of the valve stem and is of the non-rising type because control of flow is accomplished without vertical movement of the valve stem. This valve is especially suited for use in this eyewash apparatus because its rotation corresponds to that of the eyewash piping when swung from a stored to fall flow position over the sink or bowl.

In operation, the piping arm with spray heads thereon is normally disposed in a non-use position alongside the sink, so that the valve is in a no-flow position. When the eyewash needs to be activated, e.g., to wash contaminants from the eyes or face of a user, the piping connecting the valve to the eyewash is rotated about a vertical axis that preferably passes through the vertical axis of the valve. This rotation of the piping is translated to the stem of the aforementioned valve. Because the valve can be fully opened with a mere 90° rotation of its stem (See column 2, lines 38–40 of Dehnam et al. U.S. Pat. No. 4,651,770) full water flow through the eyewash is accomplished by a corresponding 90° rotation of the piping from its stored position into place over the sink. Conversely, to halt flow of water, the piping can be rotated 90° back to its storage position.

Use of this non-rising valve with ceramic discs provides an extremely reliable operation for the eyewash. As noted in Denham et al. U.S. Pat. No. 4,651,770, the ceramic valve disclosed in that patent is extremely durable (over 2,000,000 cycles without failure or leakage) and requires very little force to operate. This provides a more reliable control of water through the eyewash than the valving in U.S. Pat. No. 5,530,972 (FIG. 5) and U.S. Pat. No. 5,740,569 (FIG. 3).

The eyewash can be positioned on either the left or right side of a sink or bowl without adjustments or changes to the eyewash apparatus. This evenhandedness is facilitated by a valve shank fixed and mounted on a surface adjacent the sink or bowl. The housing to which the eyewash piping is attached overlies the portion of the shank extending above the surface adjacent the sink. An adjustable pin in the sidewall of that housing can be rotated so that it extends into an arcuate slot in the shank. The slot typically extends across a 90° arc on the outside surface of the shank. Rotation of the housing carrying the eyewash piping is thereby limited to 90° rotation (from storage to a position over the sink) by the pin in the sidewall of the housing reaching either end of the arcuate slot.

If the eyewash apparatus is to be mounted on the left side of the sink, the arcuate slot in the shank is positioned on the countertop next to the sink so that the piping can be rotated in a clockwise direction (when viewed by a person looking into the sink). When mounted on the right side of the sink, the shank is positioned on the countertop so that the arcuate slot permits counterclockwise rotation. Since evenhandedness is obtained by this orientation of the shank when the eyewash is installed, the same apparatus can be used for either left or right handed positioning of the apparatus. There is no need for the cumbersome and complex adjustments shown in U.S. Pat. No. 5,530,972.

When the position of the eyewash apparatus needs to be changed from the left to right side or vice versa, a locator pin extending from the supporting shank into the surface adjacent to sink is released from its fixed position on that surface. The supporting shank of the apparatus is rotated, about a vertical axis by the angle of 90°, and then the shank is fixed onto the surface on the opposite side of the sink or bowl by the same position locating pin. By this arrangement of the shank, the arcuate slot in the shank is oriented relative to the sink so that stop ends in the slot for stop pin carried on the housing are also shifted.

Inside the upper side of the housing is a splined female opening that mates with the splined end of a valve stem on the ceramic valve described above. Rotation of the piping attached to the housing is thereby transmitted to the valve so that water flow through the valve into the interior portions of the shank and then through the piping to the spray heads, is initiated. Counter rotation of the piping in the opposite direction, shuts off the valve and water flow. Rotational movement of the spray heads and associated piping is limited by abutment of the pin in the housing reaching either end of the arcuate slot in the shank.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description. It is to be understood that both the foregoing general description and the following detailed description are exemplary and explanatory only and are not restrictive of the invention, as claimed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 2:
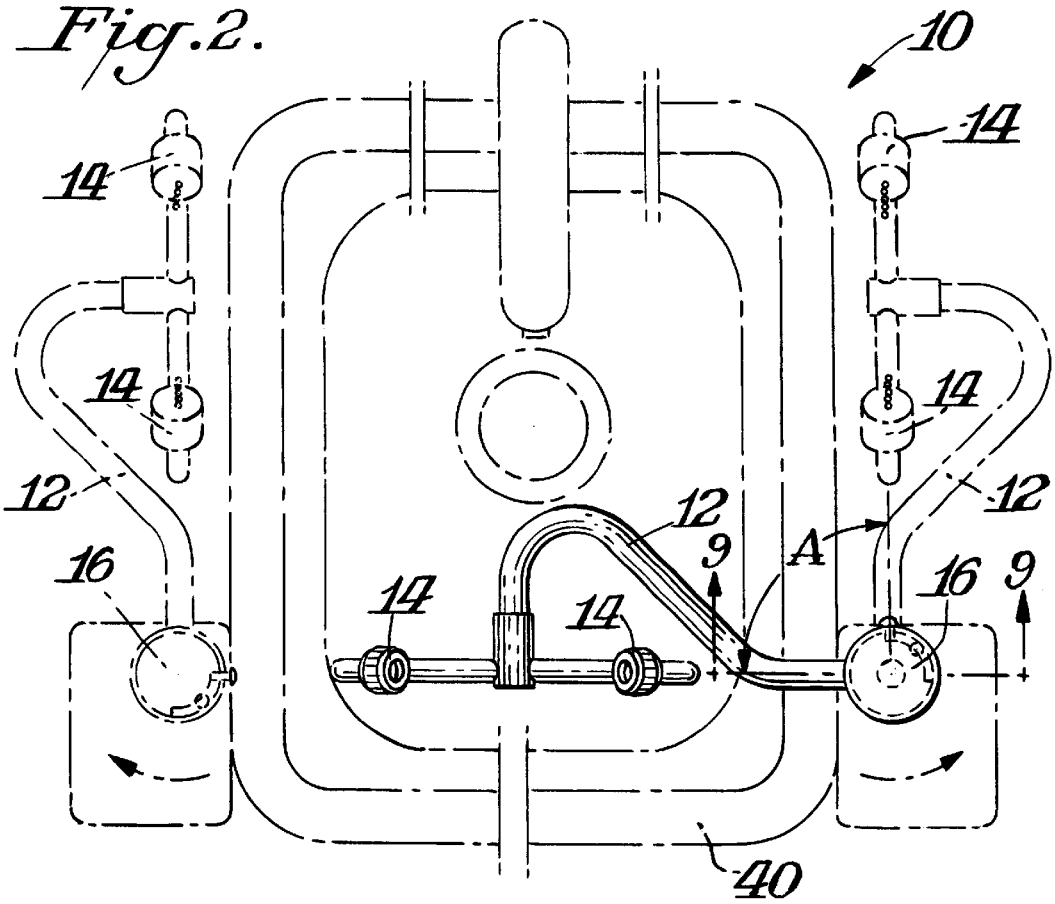
FIG. 2 is a top plan view of the emergency eyewash apparatus, wherein solid lines show said apparatus in right-hand installation) operating fluid flow position, while dotted lines show both right and left hand installations next to a sink, and a sink facility.

The following detailed description of the invention refers to the accompanying drawings. The same reference numbers in different drawings identify the same or similar elements. Also, the following detailed description does not limit the invention. Instead, the scope of the invention is defined by the appended claims and equivalents thereof.

Turning now to the drawings and specifically FIGS. 1 through 9, an emergency eyewash apparatus 10 embodying the present invention is illustrated. The emergency eyewash apparatus 10 includes tubular piping 12 with spray heads 14 attached thereto, a hollow cylindrical housing 16 rotatably carrying piping 12 and spray heads 14, a cylindrical shank 18 situated vertically and having hollow coaxial channel 20 adapted to be coupled to a coupling 22 of a water supply pipe 24 by a lower threaded projection 26 of the said shank 18.

The housing 16 is adapted to be rotatably mounted over shank 18 in a sealed relationship with shank 18. Thus, when piping 12 is grabbed by a user to wash his or her face or eyes, housing 16 is rotated relative to shank 18 which is fixed onto surface 38 surrounding sink 40 (shown in phantom in FIGS. 1, 2). Shank 18 is secured in a non-rotational relationship with surface 38 by location pin or screw 36 which extends from the plate 42 on shank 18. Pin 36 may be driven or screwed into surface 38 to secure it thereto (See FIG. 9).

The rotation of the piping initiates flow through the piping 12 to, and out of, the spray heads 14 which bathe the face, eyes or other body parts subjected to containments. A water supply 24 is connected to the eyewash apparatus 10 through suitable connectors 22 that can include an adjustable volume control. The connectors 22 are sealingly attached to threaded hollow pipe 26 typically extending downwardly from shank 18 through the surface 38 surrounding the sink or bowl 40.

Figure 3:
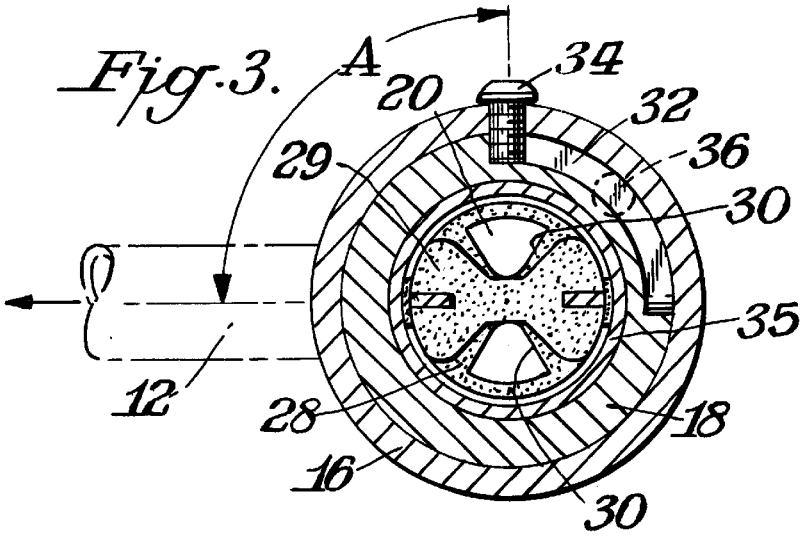
FIG. 3 is a top cross-sectional plan view through line 3—3 of FIG. 1 in in-use position, right-hand installation.
Figure 4:
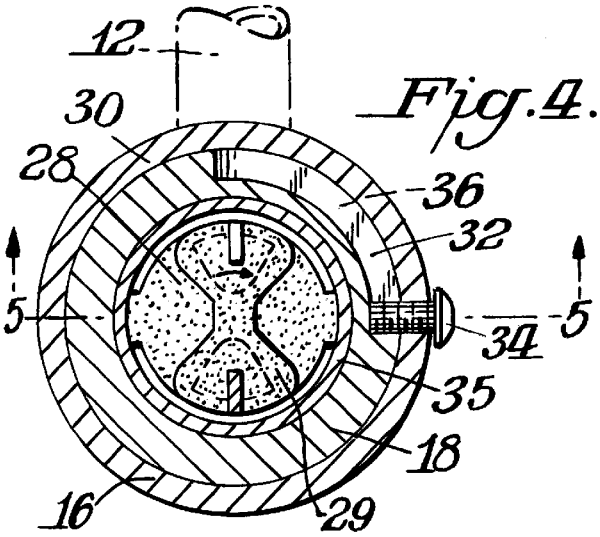
FIG. 4 is a cross-sectional plan view similar of to FIG. 3 except in non-use position, right-hand installation.
Figure 5:
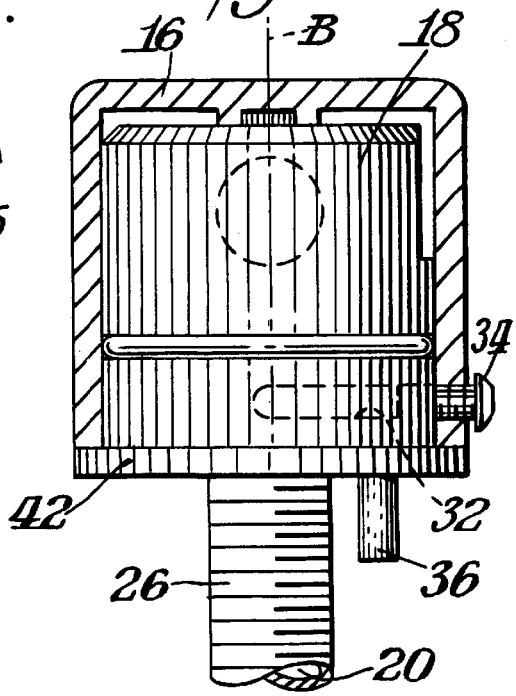
FIG. 5 is a cross-sectional elevational view taken along line 5—5 of FIG. 4.
Figure 6:
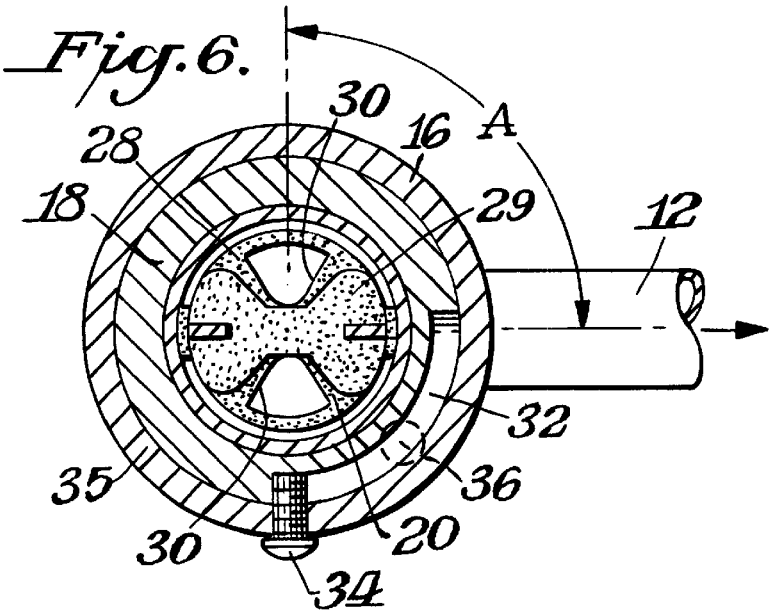
FIG. 6 is a is a cross-sectional plan view through line 6—6 of FIG. 1 in in-use position, left-hand installation.
Figure 7:
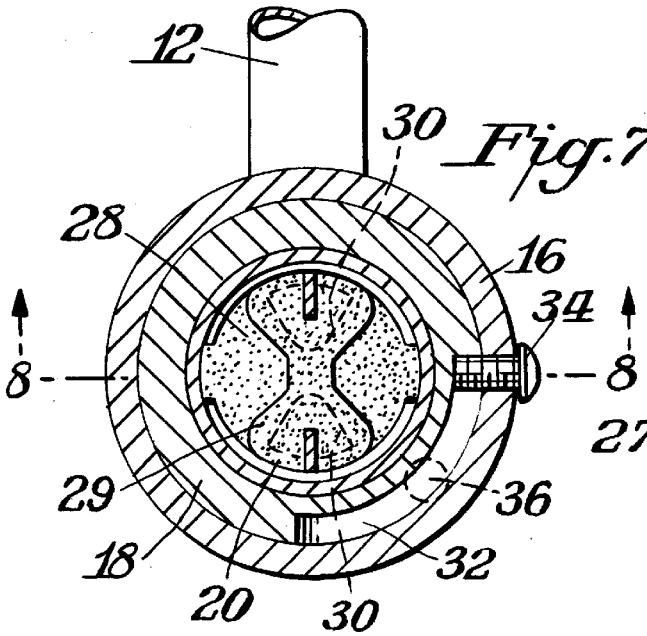
FIG. 7 is a is a cross-sectional plan view similar to FIG. 4 in non-use position, left-hand installation.
Figure 8:
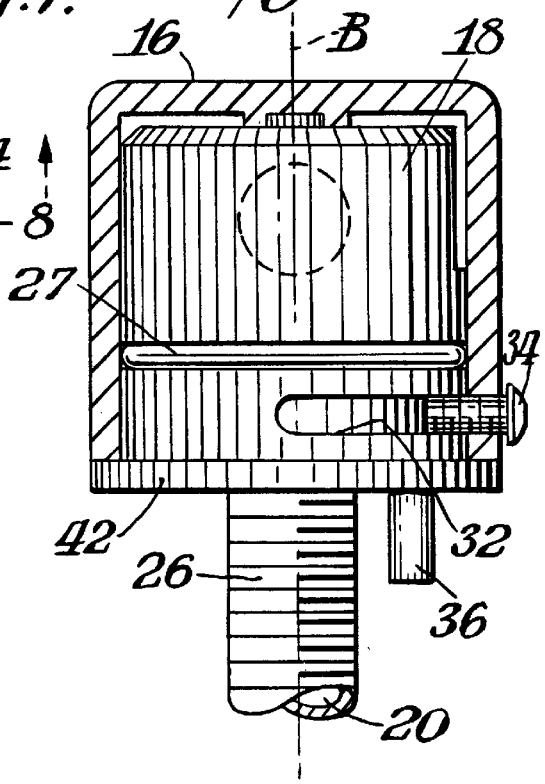
FIG. 8 is a cross-sectional elevational view taken along line 8—8 of FIG. 7.

Water flow from source 24 to and through spray heads 14 is controlled by valve 35 which is arranged in scaled engagement with the interior of shank 18 by O-rings (not shown). Valve 35 is preferably a ceramic valve with non-rising stem such as described in U.S. Pat. No. 4,651,770, the disclosure of which is incorporated herein by reference. Flow of water entering the bottom of Valve 35 through passage 20 is controlled by ceramic valve elements 28 and 29. As described in U.S. Pat. No. 4,651,770 and illustrated in FIGS. 3–4 and 6–7, passage of water through the valve depends upon alignment of ceramic element 29 relative to ports 30 in ceramic clement 28. When ceramic element 29 is rotated into a position covering ports 30 there is no flow through Valve 35 (FIGS. 4 and 7). Conversely when ceramic element 29 is rotated through angle A (typically 90°) to a position where it no longer covers ports 30 in ceramic element 28, water freely flows through Valve 35 (FIGS. 3 and 6).

Ceramic valve element 29 is attached to a stem with splined end 25 which extends outside the body of Valve 35

Figure 1:
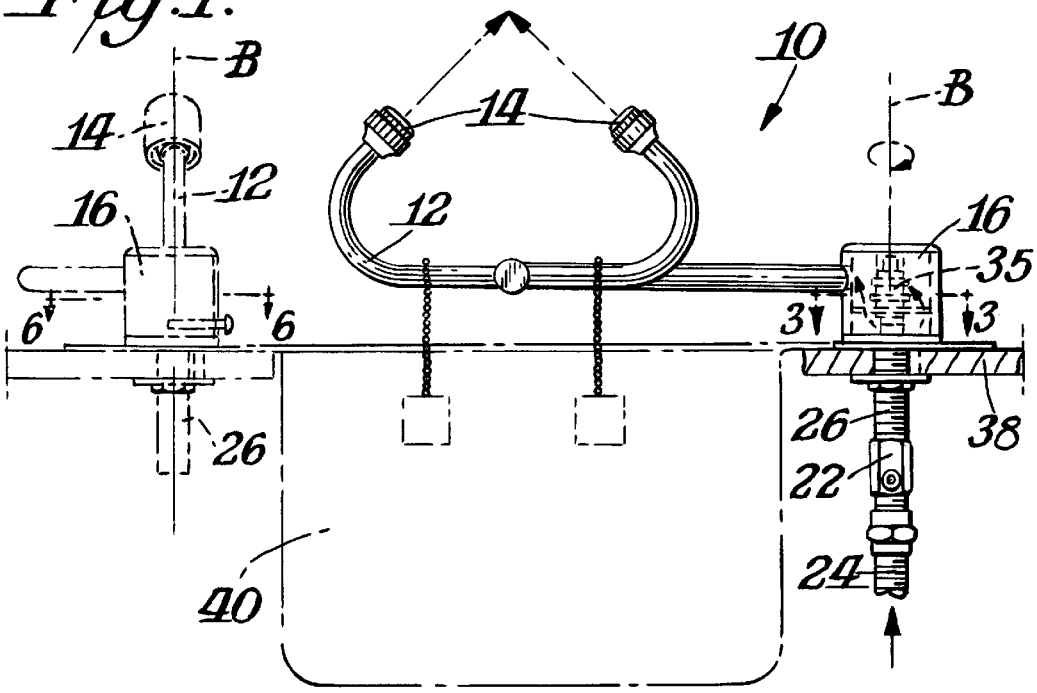
FIG. 1 is a front elevational view of the emergency eyewash apparatus embodying the present invention, solid lines showing said apparatus in right-hand installation and rotated into full flow position over a sink, and dotted lines showing said apparatus in left-hand non-flow installation.
Figure 9:
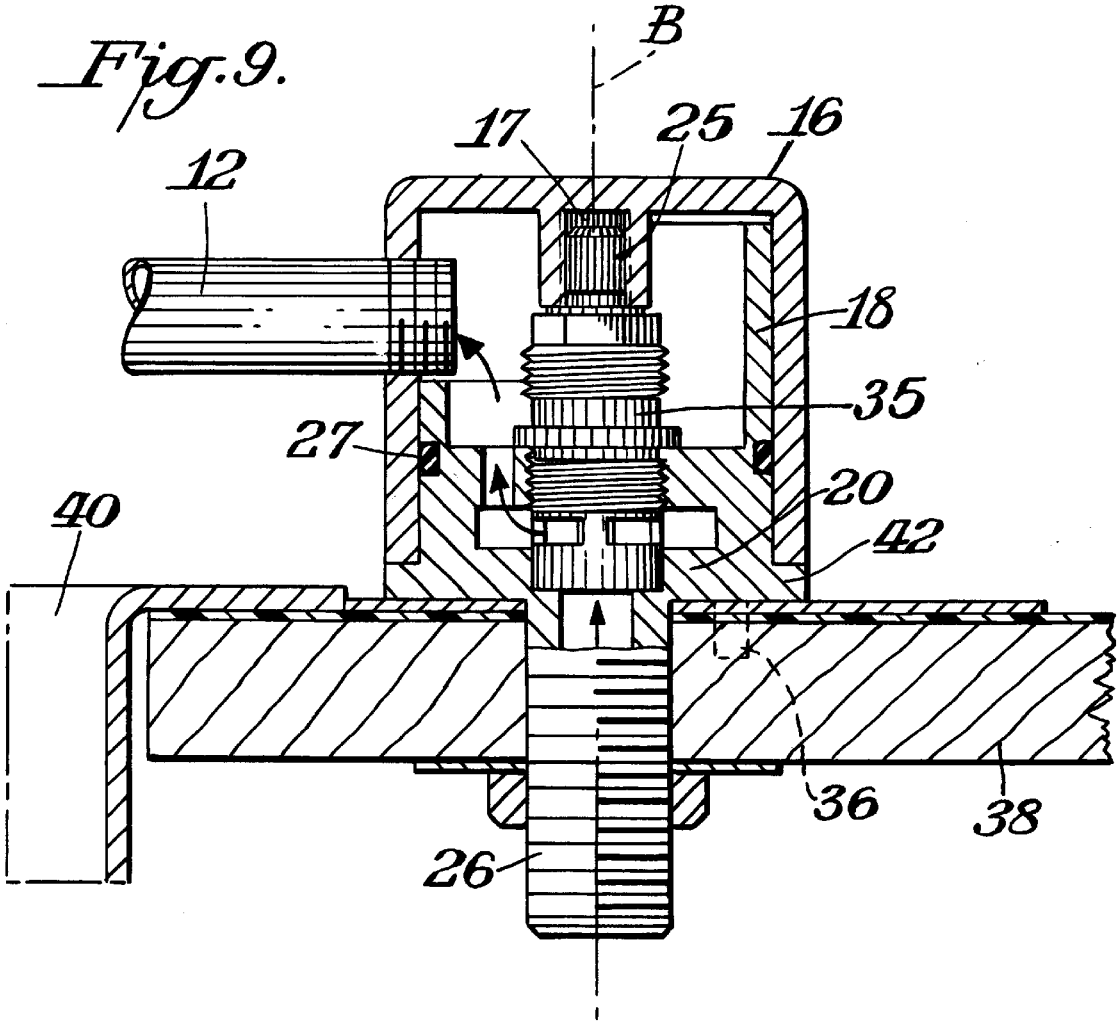
FIG. 9 is a cross sectional elevational view taken along line 9—9 of FIG. 2.

(See FIG. 9). The splined end 25 fits into a mating female splined cap 17 in the top of housing 16. Rotation of housing 16 transmits that rotation to stem 25 of Valve 35 and to ceramic valve clement 29, thereby controlling flow of water through Valve 35 to spray heads 14. As illustrated in FIG. 1 a 90° rotation of housing 16 moves piping 12 from storage to its intended use position with spray heads 14 located over the sink or bowl 40. That rotation of housing 16 transmits a like 90° rotation to valve stem 25 and attached ceramic element 29, thereby opening fill flow of water from water supply 24 to spray heads 14.

The rotation of housing 16 is limited by the relationship of stop pin 34 in the side of housing 16 to the arcuate slot 32 in shank 18. The amount of housing rotation needed to provide water flow to the spray heads 14 can be controlled by the angular extent of slot 32. Thus, in the embodiment shown, the slot 32 extends across a 90° arc in the side of shank 18. The shank 18 is fixed to surface 38 by location pin 36. Movement of the housing 16 relative to the fixed shank 18 is limited by pin 34 that may be adjusted by rotation into and out of the periphery of housing 16. When housing 16 is placed over the outer surface of shank 1.8, pin 34 is backed out of the housing so that it does not protrude beyond the inner wall of housing 16. After the housing 16 is in place over shank 18 the pin 34 is advanced into the arcuate slot 32 so that it stops movement of housing 16 when the pin 34 abuts against either end of arcuate slot 32.

This abutment of pin 34 against the ends of slot 32 prevents excess rotation of Valve 35 as well as the spray heads 14. Alignment of the spray heads 14 over the sink 40 is important so that water flow through the heads can be collected in the sink and not on the floor or surface 38. Similarly, control of valve rotation is important to assure water flow through Valve 35. If pin 34 in slot 32 did not stop rotation of the valve stem 25, ceramic element 29 might block opening 30 in ceramic element 28 thereby preventing, or unduly limiting, needed water flow through Valve 35 to spray heads 14.

The use of this eyewash apparatus 10 on either the left or right sink for a sink or bowl 40 is facilitated by the construction just described, FIGS. 3 and 4 illustrate use of the apparatus 10 in a right-hand installation, i.e. on the right side of a sink. In FIG. 3 piping 12 with associated heads 14 has been rotated into position over sink 40 (not shown). In that position, pin 34 abuts against one end of slot 32 preventing further counterclockwise movement of housing 16 and piping 12. This assures placement of the piping 12 and spray heads 14 in the proper position over sink 40. Abutment of pin 34 against the end of slot 32 also assures proper alignment of ceramic valve elements 28 and 29 so that water flow through ports 30 is facilitated. When not in use the piping 12 is in the position illustrated in FIG. 4. In this non-use position, pin 34 abuts against the opposite end of arcuate slot 32. In this position the flow of water through Valve 35 is shut off. Abutment of pin 34 against the end of slot 32 assures that piping 12 does not rotate any further thereby maintaining ceramic element 29 over ports 30 in ceramic valve element 28 to prevent water flow through Valve 35 in this non-use, storage position of apparatus 10.

Left hand operation of apparatus 10 does not require any change to the shank 18 or housing 16, A simple repositioning of locator pin 36 on surface 38 and twist of piping 12 is all that is needed to change from right hand to left hand operation. More particularly, in left hand to operation the arcuate slot 32 is positioned so that it is rotated clockwise about 90° from its position for right hand operation. (Compare location of slot 32 in FIG. 3 with FIG. 6). This is accomplished by placement of locator pin 36 in surface 38 at a different position (5 o'clock as shown in FIGS. 6, 7) from its position for right-hand operations (2 o'clock as shown in FIGS. 3, 4). There is thus, no structural change to any parts needed to accommodate either right or left-hand operation of the apparatus. To complete the change from right to left hand operation all that need be done is to twist piping in housing 16 so that the bend in the piping is facing away from the sink (See FIG. 1). Thus, identical components of the eyewash apparatus can be used for either right or left hand operations.

The invention has been illustrated by detailed description and examples of the preferred embodiment. Various changes in form and detail will be within the skill of persons skilled in the art. Therefore, the invention must be measured by the claims and not by the description of the examples or the preferred embodiments. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An emergency eyewash apparatus arranged for use over sink or bowl comprising a. spray heads for discharging fluid toward and onto a user, b. piping connecting the spray heads to a housing overlying a valve, c. a valve stem extending from the valve into engagement with the housing, d. a shank arranged in sealing engagement with the housing and having a location pin extending therefrom capable of affixing the shank in a non-rotatable relationship with a surface adjacent the sink or bowl, e. an arcuate slot on an upstanding wall of the shank cooperating with a pin extending through the side of the housing to limit rotational movement of the housing and valve stem.

2. The eyewash apparatus of claim 1 wherein the valves utilizes a non-rising stem.

3. The eyewash apparatus of claim 1 wherein the valve is a ceramic valve.

4. The eyewash apparatus of claim 2 wherein 90° rotation of the valve stem permits full fluid flow through the valve.

5. The eyewash of claim 1 wherein the eyewash apparatus can be used on opposite sides of the sink or bowl without a structural change to shank, housing or valve.

* * * * *

UNITED STATES PATENT AND TRADEMARK OFFICE

CERTIFICATE OF CORRECTION

PATENT NO. : 6,520,431 B2
DATED : February 18, 2003
INVENTOR(S) : Clarence P. Donovan It is certified that error appears in the above-identified patent and that said Letters Patent is hereby corrected as shown below:

Column 6,
Line 49, delete “valves” and insert -- valve --.

Signed and Sealed this

Fifteenth Day of April, 2003

JAMES E. ROGAN
*Director of the United States Patent and Trademark Office*